US012208487B2

(12) United States Patent
Huang et al.

(10) Patent No.: US 12,208,487 B2
(45) Date of Patent: Jan. 28, 2025

(54) CHEMICAL MECHANICAL POLISHING APPARATUS AND METHOD

(71) Applicant: Taiwan Semiconductor Manufacturing Co., Ltd., Hsinchu (TW)

(72) Inventors: Chun-Hsi Huang, Hsinchu (TW); Chia-Lin Hsueh, Zhubei (TW); Huang-Chu Ko, Miaoli County (TW)

(73) Assignee: Taiwan Semiconductor Manufacturing Co., Ltd., Hsinchu (TW)

( * ) Notice: Subject to any disclaimer, the term of this patent is extended or adjusted under 35 U.S.C. 154(b) by 1289 days.

(21) Appl. No.: 16/407,969

(22) Filed: May 9, 2019

(65) Prior Publication Data

US 2020/0130136 A1 Apr. 30, 2020

Related U.S. Application Data

(60) Provisional application No. 62/752,272, filed on Oct. 29, 2018.

(51) Int. Cl.
*B24B 49/00* (2012.01)
*B24B 37/005* (2012.01)
(Continued)

(52) U.S. Cl.
CPC ..... *B24B 49/006* (2013.01); *B24B 37/005* (2013.01); *B24B 37/042* (2013.01);
(Continued)

(58) Field of Classification Search
CPC ..... B24B 53/005; B24B 53/017; B24B 53/12; B24B 49/08; B24B 49/10; B24B 49/12; B24B 49/18; B24B 49/19
See application file for complete search history.

(56) References Cited

U.S. PATENT DOCUMENTS 5,618,447 A * 4/1997 Sandhu ..... B24B 49/02 216/88
6,040,244 A * 3/2000 Arai ..... B24B 49/04 438/692
(Continued)

FOREIGN PATENT DOCUMENTS

CN 1943990 A 4/2007
CN 102744677 A 10/2012
(Continued)

OTHER PUBLICATIONS

English Translation of Taiwanese Patent Application TW 201128694 (Year: 2011).*
(Continued)

*Primary Examiner* — Joel D Crandall
(74) *Attorney, Agent, or Firm* — Sterne, Kessler, Goldstein & Fox P.L.L.C.

(57) ABSTRACT

The present disclosure describes an apparatus and a method to detect a polishing pad profile during a polish process and adjust the polishing process based on the detected profile. The apparatus can include a polishing pad configured to polishing a substrate, a substrate carrier configured to hold the substrate against the polishing pad, and a detection module configured to detect a profile of the polishing pad. The detection module can include a probe configured to measure a thickness of one or more areas on the polishing pad, and a beam configured to support the probe, where the probe can be further configured to move along the beam.

20 Claims, 8 Drawing Sheets

(51) Int. Cl.
*B24B 37/04* (2012.01)
*B24B 37/20* (2012.01)
*B24B 49/10* (2006.01)
*B24B 49/12* (2006.01)

(52) U.S. Cl.
CPC ..... *B24B 37/20* (2013.01); *B24B 49/003* (2013.01); *B24B 49/10* (2013.01); *B24B 49/12* (2013.01)

(56) References Cited

U.S. PATENT DOCUMENTS

| | | | | |
|---|---|---|---|---|
| 6,045,434 | A * | 4/2000 | Fisher, Jr. | B24B 37/005 451/21 |
| 6,169,931 | B1 * | 1/2001 | Runnels | B24B 37/26 700/121 |
| 6,872,132 | B2 * | 3/2005 | Elledge | B24B 49/003 451/6 |
| 8,221,191 | B2 * | 7/2012 | Matsuzaki | B24B 37/013 451/21 |
| 10,792,783 | B2 * | 10/2020 | Hu | B24B 53/005 |
| 2002/0197934 | A1 * | 12/2002 | Paik | H01L 22/20 451/21 |
| 2003/0027424 | A1 * | 2/2003 | Paik | B24B 37/042 438/692 |
| 2004/0038534 | A1 | 2/2004 | Taylor | |
| 2004/0043521 | A1 | 3/2004 | Elledge | |
| 2004/0176018 | A1 * | 9/2004 | Elledge | B24B 49/003 451/56 |
| 2004/0192168 | A1 | 9/2004 | Faustmann | |
| 2005/0026546 | A1 * | 2/2005 | Elledge | B24B 49/18 451/5 |
| 2007/0082582 | A1 | 4/2007 | Gwo et al. | |
| 2009/0137190 | A1 | 5/2009 | Togawa et al. | |
| 2010/0035518 | A1 * | 2/2010 | Chang | B24B 37/042 451/6 |
| 2010/0081361 | A1 * | 4/2010 | Fukuda | B24B 53/017 451/5 |
| 2011/0237161 | A1 * | 9/2011 | Kiesel | B24B 37/04 451/364 |
| 2012/0100779 | A1 * | 4/2012 | Dhandapani | B24B 53/007 451/5 |
| 2012/0270474 | A1 | 10/2012 | Liao et al. | |
| 2014/0273752 | A1 | 9/2014 | Bajaj et al. | |
| 2016/0271749 | A1 * | 9/2016 | Shinozaki | B24B 49/10 |
| 2017/0059311 | A1 * | 3/2017 | Cho | B24B 37/20 |
| 2017/0095903 | A1 | 4/2017 | Galpin et al. | |
| 2017/0239777 | A1 * | 8/2017 | Chung | B24B 49/12 |
| 2018/0264619 | A1 | 9/2018 | Yoshida | |
| 2020/0061774 | A1 * | 2/2020 | Matsushita | B24B 53/017 |
| 2022/0097206 | A1 * | 3/2022 | Lee | B24B 53/005 |
| 2023/0381918 | A1 | 11/2023 | Huang et al. | |

FOREIGN PATENT DOCUMENTS

| | | | | |
|---|---|---|---|---|
| CN | 103381575 | A | | 11/2013 |
| CN | 207120114 | U | | 3/2018 |
| CN | 108326720 | A | * | 7/2018 |
| TW | 200936316 | A | | 9/2009 |
| TW | 201128694 | A | * | 8/2011 |
| TW | 201243277 | A | | 11/2012 |
| TW | 201446420 | A | | 12/2014 |
| TW | 201600241 | A | | 1/2016 |
| TW | 201711801 | A | | 4/2017 |

OTHER PUBLICATIONS

English Translation of Chinese Patent Application CN 108326730 (Year: 2018).*

* cited by examiner

CHEMICAL MECHANICAL POLISHING APPARATUS AND METHOD

RELATED APPLICATION

This application claims the benefit of U.S. Provisional Patent Application No. 62/752,272, filed Oct. 29, 2018, titled "Chemical Mechanical Polishing (CMP) Apparatus and Method." which is incorporated by reference herein in its entirety.

BACKGROUND

The semiconductor integrated circuit (IC) industry has experienced rapid growth. Technological advances in IC materials and design have produced generations of ICs where each generation has smaller and more complex circuits than the previous generation. However, these advances have increased the complexity of processing and manufacturing ICs and, for these advances to be realized, similar developments in IC processing and manufacturing are needed. In the course of IC evolution, functional density (i.e., the number of interconnected devices per chip area) has generally increased while geometry size (i.e., the smallest component (or line) that can be created using a fabrication process) has decreased. This scaling down process generally provides benefits by increasing production efficiency and lowering associated costs.

A manufacturing process used to planarize layers of an IC is chemical mechanical polishing (CMP). The CMP process combines chemical removal with mechanical polishing. The CMP process polishes and removes materials from the wafer and can be used to planarize multi-material surfaces. Furthermore, the CMP process does not use hazardous gasses and can be a low-cost process.

BRIEF DESCRIPTION OF THE DRAWINGS

Aspects of the present disclosure are best understood from the following detailed description when read with the accompanying figures. In accordance with the common practice in the industry, various features are not drawn to scale. In fact, the dimensions of the various features can be arbitrarily increased or reduced for clarity of illustration and discussion.

DETAILED DESCRIPTION

Figure 1:
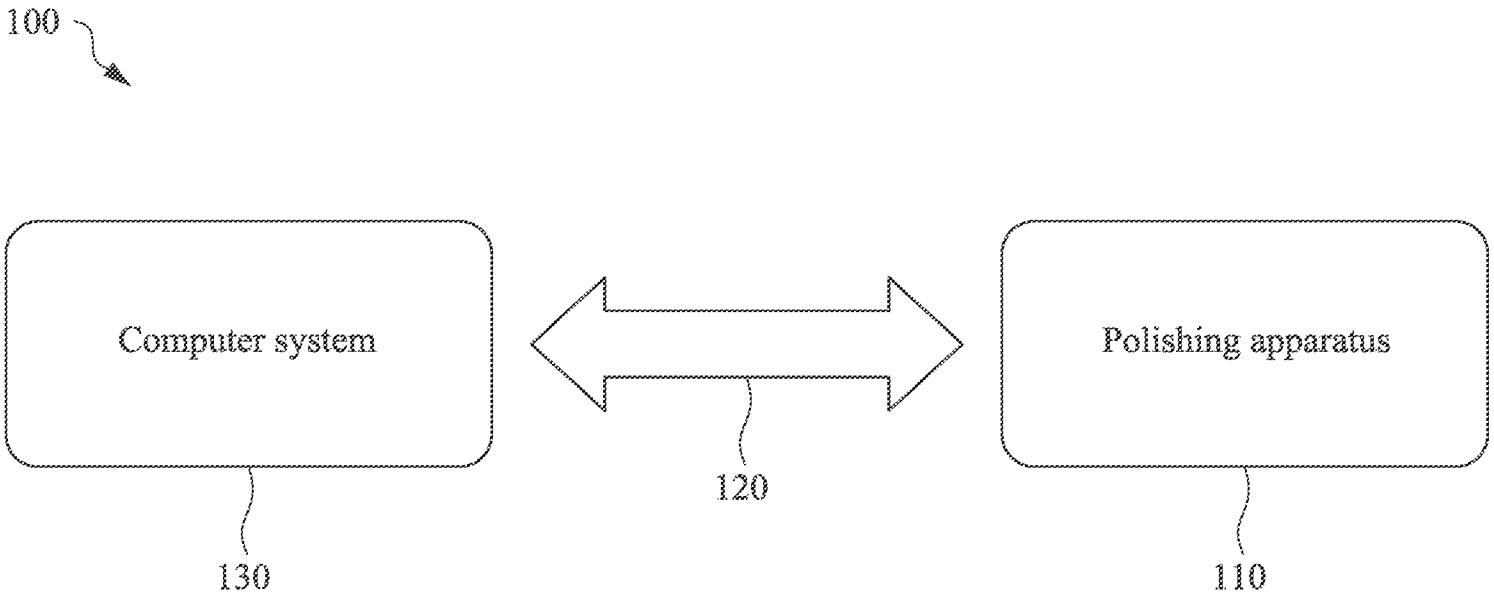
FIG. 1 illustrates a schematic of a polishing system, according to some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over a second feature in the description that follows can include embodiments in which the first and second features are formed in direct contact, and can also include embodiments in which additional features are disposed between the first and second features, such that the first and second features are not in direct contact. In addition, the present disclosure can repeat reference numerals and/or letters in the various examples. This repetition does not in itself dictate a relationship between the various embodiments and/or configurations discussed.

Further, spatially relative terms, such as "beneath," "below," "lower," "above," "upper." and the like, can be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus can be otherwise oriented (rotated 90 degrees or at other orientations) and the spatially relative descriptors used herein can likewise be interpreted accordingly.

The term "nominal" as used herein refers to a desired, or target, value of a characteristic or parameter for a component or a process operation, set during the design phase of a product or a process, together with a range of values above and/or below the desired value. The range of values can be due to slight variations in manufacturing processes or tolerances.

The term "vertical," as used herein, means nominally perpendicular to a level ground.

The term "substantially" as used herein indicates the value of a given quantity that can vary based on a particular technology node associated with the subject semiconductor device. In some embodiments, based on the particular technology node, the term "substantially" can indicate a value of a given quantity that varies within, for example, ±5% of a target (or intended) value.

The term "about" as used herein indicates the value of a given quantity that can vary based on a particular technology node associated with the subject semiconductor device. In some embodiments, based on the particular technology node, the term "about" can indicate a value of a given quantity that varies within, for example, 5-30% of the value (e.g., ±5%, ±10%, ±20%, or ±30% of the value).

The CMP process involves placing a substrate in a substrate carrier in an upside-down position with a surface to be polished facing a polishing pad. The substrate carrier and the substrate are rotated as a downward pressure is applied to the substrate against the polishing pad. A chemical solution, referred to as "a CMP slurry," is deposited onto the surface of the polishing pad to aid in the planarization process. Thus, the surface of the substrate can be planarized using a combination of mechanical (grinding) and chemical (CMP slurry) forces.

As part of the CMP process, the polishing pad can be conditioned using a pad conditioner. The pad conditioner can include a conditioning disk with a rough surface. The conditioning disk can be attached to a conditioning arm with a set of screws. The conditioning process can roughen and texturize the surface of the polishing pad to provide a rougher surface for better slurry distribution and polishing. The conditioning process can also remove accumulated debris build-up and excess slurry from the polishing pad.

The CMP process thins down the polishing pad and wears the polishing pad. The polishing pad wear can include a thickness variations along the polishing pad surface, where one or more local areas of the polishing pad can exhibit aggressive thickness loss. These local thickness losses can be mechanical stress weak points and can cause polishing pad failure. Moreover, the polishing pad thickness variations can also impact yield and reliability of the CMP process.

This disclosure is directed to an apparatus and a method for a CMP process that uses a detection module to measure a thickness of one or more areas of the polishing pad during the CMP process. One or more parameters of the CMP process are adjusted based on the measurements. Such CMP apparatus embodiments can reduce the polishing pad wear, thus preventing a failure of the CMP process and improving substrate yield.

FIG. 1 is a schematic of a polishing system 100 for a polishing process, according to some embodiments of the present disclosure. As illustrate in FIG. 1, polishing system 100 can include a polishing apparatus 110, a communication link 120, and a computer system 130, where polishing apparatus 110 and computer system 130 can be configured to communicate with each other via communication link 120. Polishing apparatus 110 can be configured to perform a polishing process based on instructions received from computer system 130. Polishing apparatus 110 can include a polishing pad (not shown in FIG. 1) and a detection module (not shown in FIG. 1) configured to detect a profile of the polishing pad during the polishing process, where the profile can include information on thickness, surface roughness, and/or surface contour of one or more areas of the polishing pad. Polishing apparatus 110 can be further configured to send data associated with the detected profile to computer system 130. In some embodiments, polishing apparatus 110 can be a chemical mechanical polishing (CMP) apparatus. In some embodiments, communication link 120 can be a wire or wireless link between polishing apparatus 110 and computer system 130.

Computer system 130 can be configured to store the polishing process instructions, which can include one or more polishing process parameters. Computer system 130 can be further configured to send the instructions to polishing apparatus 110 via communication link 120. Computer system 130 can receive the data of the detected profile from polishing apparatus 110 and can be configured to generate an adjustment of the one or more parameters of the polishing process. Computer system 130 can be further configured to update the instructions based on the adjustment.

Figure 2:
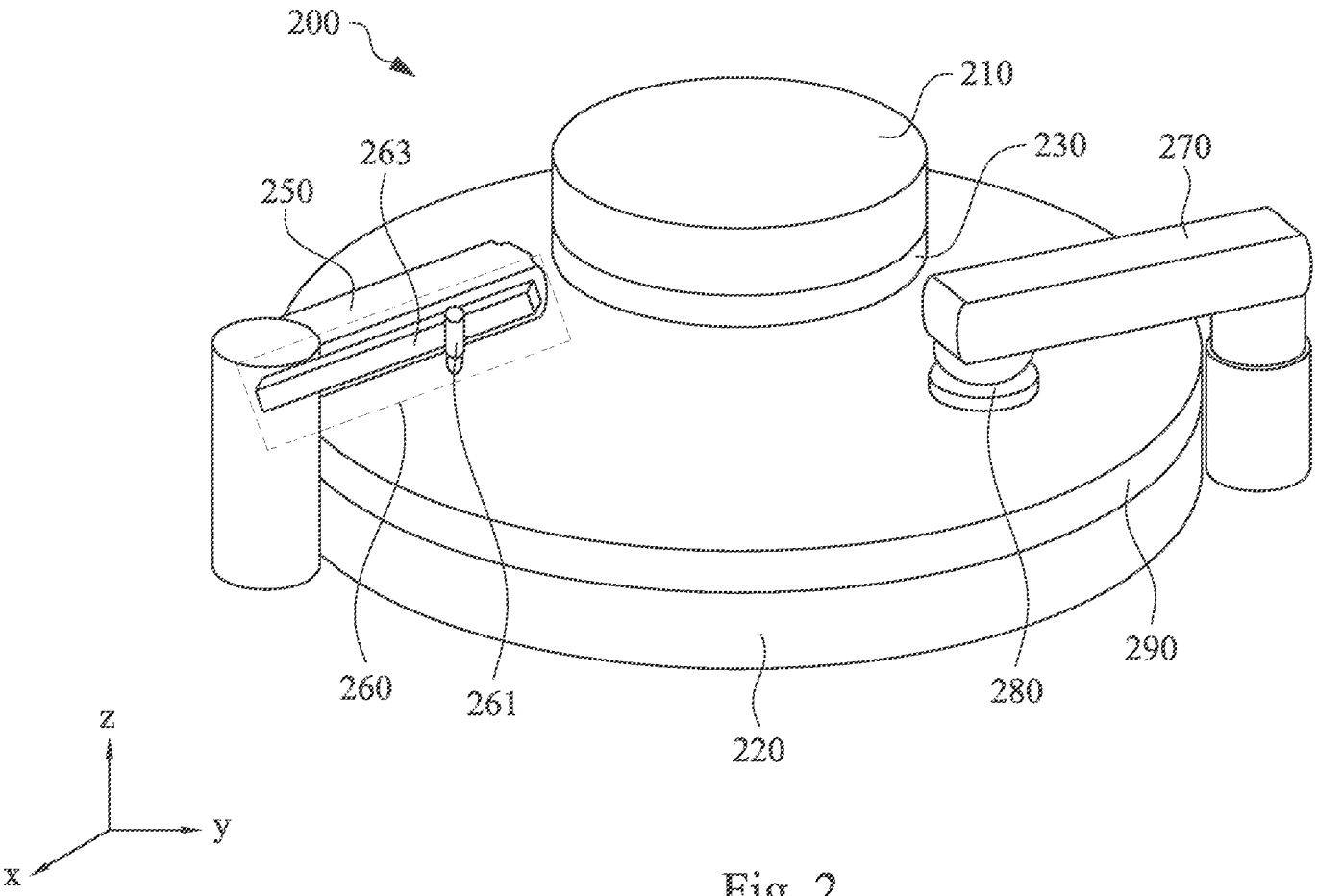
FIG. 2 illustrates a schematic of a polishing apparatus, according to some embodiments of the present disclosure.

FIG. 2 is a schematic of a polishing apparatus 200, according to some embodiments of the present disclosure. Polishing apparatus 200 can include a substrate carrier 210, a polishing pad 290, a platen 220 configured to support and rotate the polishing pad 290, a slurry dispenser 250 positioned over polishing pad 290, a pad conditioner 270 positioned over polishing pad 290, and a detection module 260 attached to slurry dispenser 250. Substrate carrier 210 can be configured to hold and rotate a semiconductor substrate 230. Polishing pad 290 can be configured to polish semiconductor substrate 230. In some embodiments, one or both polishing pad 290 and substrate carrier 210 rotate during a polishing process. Slurry dispenser 250 can be configured to deliver and dispense a slurry onto polishing pad 290. In some embodiments, the slurry can be a CMP slurry. Pad conditioner 270 can be configured to condition polishing pad 290 (e.g., roughen and texturize the surface of polishing pad 290). Detection module 260 can be configured to detect a profile of polishing pad 290. In some embodiments, detection module 260 can be configured to detect a profile of one or more areas of polishing pad 290, where the profile can include a thickness, a surface roughness, or a surface contour of the one or more areas of polishing pad 290.

In some embodiments, polishing apparatus 200 can be a CMP apparatus. The polishing process can be a CMP process. In some embodiments, the polishing process can include a substrate polishing process or a conditioning process.

Substrate carrier 210 can be configured to hold and rotate semiconductor substrate 230. Semiconductor substrate 230 can be mounted in an upside-down position so a surface to be polished faces polishing pad 290. A vacuum can be applied to secure semiconductor substrate 230 onto substrate carrier 210. Substrate carrier 210 can bring semiconductor substrate 230 into contact with rotating polishing pad 290, thereby polishing the surface of semiconductor substrate 230. In some embodiments, substrate carrier 210 can further include a rotatable shaft (not shown in FIG. 2) to rotate semiconductor substrate 230.

Substrate carrier 210 can include a retainer ring to keep semiconductor substrate 230 in a predetermined position and prevent detachment of semiconductor substrate 230 from substrate carrier 210. The retainer ring can be used to reduce lateral movement of semiconductor substrate 230 during the polishing process. In some embodiments, suitable materials for the retainer ring can include, but is not limited to, polyvinyl alcohol (PVA), polyvinyl chloride (PVC), polyurethane (PU), polyethylene terephthalate (PET), polyethylene (PE), polystyrene (PS), polypropylene (PP), polycarbonates (PC), or a combination thereof. In some embodiments, the retainer ring is made from a non-porous material. In some embodiments, the retainer ring is made from a porous material in some embodiments, a pore size in the retainer ring ranges from about 0.5 μm to about 100 μm. In some embodiments, a porosity of the retainer ring is equal to or less than about 70%. In some embodiments, a compressibility of the retainer ring ranges from about 1% to about 50%.

In some embodiments, semiconductor substrate 230 includes a semiconductor body as well as an overlying dielectric material layer (e.g., oxide) and an overlying metal layer. In some embodiments, the semiconductor body can include, but is not limited to, silicon, germanium, an III-V semiconductor material (e.g., a combination of one or more group III elements with one or more group V elements). The dielectric material layer and the metal layer can share a common interface that faces the rotating polishing pad 290. In some embodiments, the metal layer can include, but is not limited to, germanium, copper, or aluminum. In some embodiments, the dielectric material layer can include, but is not limited to, silicon dioxide. In some embodiments, semiconductor substrate 230 can be a wafer (e.g., a silicon wafer) in some embodiments, semiconductor substrate 230 can be (i) pure element semiconductor including silicon and/or germanium; (ii) a compound semiconductor including silicon carbide (SiC), gallium arsenide (GaAs), gallium phosphide (GaP), indium phosphide (InP), indium arsenide (InAs), gallium arsenide phosphide (GaAsP), aluminum indium arsenide (AlInAs), aluminum gallium arsenide (AlGaAs), gallium indium arsenide (GaInAs), gallium indium phosphide (GaInP), gallium indium arsenide phosphide (GaInAsP), and indium antimonide (InSb); (iii) an alloy semiconductor including silicon germanium (SiGe), or (iv) a combination thereof in some embodiments, semiconductor substrate 230 can be a semiconductor on insulator (SOI). In some embodiments, semiconductor substrate 230 can be an epitaxial material.

Polishing pad 290 can be configured to polish semiconductor substrate 230. In some embodiments, polishing pad 290 is located on a top surface of a platen 220, which rotates polishing pad 290 about an axis of rotation during the polishing process. Polishing pad 290 can be mounted on platen 220 by an adhesive. During the polishing process, polishing pad 290 can be pressed and brought into contact with a surface of semiconductor substrate 230 at a specific pressure. In some embodiments, polishing pad 290 can be several times the diameter of semiconductor substrate 230 and semiconductor substrate 230 can be kept off-center on polishing pad 290 during the polishing process to prevent polishing a non-planar surface onto semiconductor substrate 230.

Polishing pad 290 can be a plate having a predetermined thickness, roughness (e.g., pore size), surface contour, hardness, gravity, and/or pad compressibility. In some embodiments, polishing pad 290 can be a circular plate. Polishing pad 290 can be a hard, incompressible polishing pad or a soft polishing pad depending on the surface to be polished. For example, hard and stiffer polishing pads can be used for oxide polishing to achieve planarity. In some embodiments, hard polishing pad material can include, but is not limited to, polyurethane, urethane, polymer, a filler material, or a combination thereof. Softer polishing pads can be used in other polishing processes (e.g., for copper and polysilicon polishing) to achieve improved uniformity and smooth surfaces. A soft polishing pad material can include, but is not limited to, polyurethane impregnated felt or felt. The hard polishing pads and the soft polishing pads can also be combined in an arrangement of stacked pads for customized applications. In some embodiments, polishing pad 290 can include porous polymeric materials with a pore size between about 30 μm and about 50 μm.

Pad compressibility can dictate how polishing pad 290 conforms to the semiconductor substrate 230 surface undergoing polishing. To obtain a polishing rate that is uniform across semiconductor substrate 230 surface, polishing pad 290 should conform to the semiconductor substrate 230 surface on a long range scale. In some embodiments, the long range scale can vary between about 30 cm and about 50 cm. In some embodiments, a relatively highly compressible polishing pad material can have a compressibility factor between about 2 and about 50.

In some embodiments, polishing pad 290 can further include surface grooves (not shown in FIG. 2) to facilitate even distribution of the slurry solution and to help trap undesirable particles formed by coagulated slurry solution or any other foreign particles which have fallen on polishing pad 290 during the polishing process.

The polishing process consumes polishing pad 290 and hence causes wear on polishing pad 290. Detection module 260 can be configured to detect a profile of polishing pad 290 to gauge the amount of wear on polishing pad 290. Detection module 260 can include a probe 261 configured to measure a profile, which can include information—such as a thickness, a surface roughness, and/or a surface contour—of one or more areas of polishing pad 290. Detection module 260 can also include a beam 263 configured to support probe 261, where probe 261 can be configured to move along beam 263. Since detection module 260 can be attached to slurry dispenser 250, probe 261 can be extended over and swept across a surface of polishing pad 290. In some embodiments, beam 263 can be configured to extend over polishing pad 290 and sweep across a surface of polishing pad 290.

Platen 220 can be configured to support and rotate polishing pad 290. In some embodiments, platen 220 can receive a rotational force from a motor (not shown in FIG. 2) disposed in a lower base (not shown in FIG. 2). Platen 220 can thus rotate around an imaginary rotational axis perpendicular to a top surface of platen 220. In some embodiments, platen 220 rotates polishing pad 290 in a clockwise direction. In some embodiments, platen 220 rotates polishing pad 290 in a counter-clockwise direction. Substrate carrier 210 and polishing pad 290 can rotate independently in the same direction or different directions with the same or different rotational speed.

Slurry dispenser 250 can be configured to deliver and dispense a slurry onto polishing pad 290. The composition of the slurry depends on the type of material on the semiconductor substrate surface undergoing the polishing process. In some embodiments, the slurry can include a first reactant, an abrasive, a first surfactant, and a solvent.

The first reactant can be a chemical that reacts with a material of semiconductor substrate 230 (e.g., a conductive material) to assist polishing pad 290 in grinding away the material, such as an oxidizer. In some embodiments in which the material on the surface of semiconductor substrate 230 is tungsten, the first reactant can include, but is not limited to, hydrogen peroxide, hydroxylamine, periodic acid, ammonium persulfate, other periodates, iodates, peroxomono, sulfates, peroxymonosulfuric acid, perborates, malonamide, or a combination thereof. In some embodiments in which the material on the surface of semiconductor substrate is an oxide, the first reactant can include a nitric acid ($HNO_3$) reactant.

The abrasive can be any suitable particles that, in conjunction with polishing pad 290, aids in the planarization of semiconductor substrate 230. In some embodiments, the abrasive can be colloidal silica (e.g., silicon oxide) or fumed silica. Any other suitable abrasive, such as aluminum oxide, cerium oxide, polycrystalline diamond, polymer particles such as polymethacrylate or polymethacrylic, or a combination thereof, can be used. In some embodiments, the slurry can be abrasive free (i.e., the slurry does not include abrasive particles).

The first surfactant can be utilized to lower the surface tension of the slurry and disperse the first reactant and the abrasive within the slurry and also prevent or reduce the abrasive from agglomerating during the polishing process. In some embodiments, the first surfactant can include, but is not limited to, sodium salts of polyacrylic acid, potassium oleate, sulfosuccinates, sulfosuccinate derivatives, sulfonated amines, sulfonated amides, sulfates of alcohols, alkylanyl sulfonates, carboxylated alcohols, alkylamino propionic acids, alkyliminodipropionic acids, potassium oleate, sulfosuccinates, sulfosuccinate derivatives, sulfates of alcohols, alkylanyl sulfonates, carboxylated alcohols, sulfonated amines, sulfonated amides, alkylamino propionic acids, alkyliminodipropionic acids, or a combination thereof.

The solvent can be utilized to combine the first reactant, the abrasive, and the first surfactant and allow the mixture to be moved and dispersed onto polishing pad 290. In some embodiments, the solvent can be deionized water, an alcohol, or a combination thereof.

Pad conditioner 270 can include a conditioning disk 280 mounted on a conditioning arm with screws, according to some embodiments of the present disclosure. In some embodiments, the conditioning arm can be extended over the top of polishing pad 290 to sweep (e.g., in an arc motion)

across the entire surface of polishing pad 290. As platen 220 rotates, different areas of polishing pad 290 can be fed under substrate carrier 210 and used to polish the substrate. In some embodiments, platen 220 moves areas of polishing pad 290 that were previously in contact with semiconductor substrate 230 to pad conditioner 270. The conditioning arm sweeps pad conditioner 270 across the areas previously used to polish semiconductor substrate 230 and conditions these areas. Platen 220 then moves these areas back under substrate carrier 210 and semiconductor substrate 230. In this manner, polishing pad 290 can be conditioned—e.g., simultaneously conditioned—while semiconductor substrate 230 is polished.

Conditioning disk 280 can have different compositions. In some embodiments, conditioning disk 280 can include a brazed grid-type conditioning disk, a diamond grid-type conditioning disk, or a combination thereof. A brazed grid-type conditioning disk can be formed by embedding or encapsulating diamond particles at random spacings on the surface of a stainless steel substrate. A diamond grid-type conditioning disk can be formed by embedding cut diamonds at regular spacings in a nickel film coated onto the surface of a stainless steel substrate. The diamonds are coated with a diamond-like carbon (DLC) layer. Conditioning disk 280 can be used to roughen and condition a surface of polishing pad 290. Due to the conditioning by conditioning disk 280, the surface of polishing pad 290 is refreshed and the polishing rate can be maintained. The pad conditioning process can be carried out either during a polishing process, i.e. known as concurrent conditioning, or after the polishing process.

Figure 3:
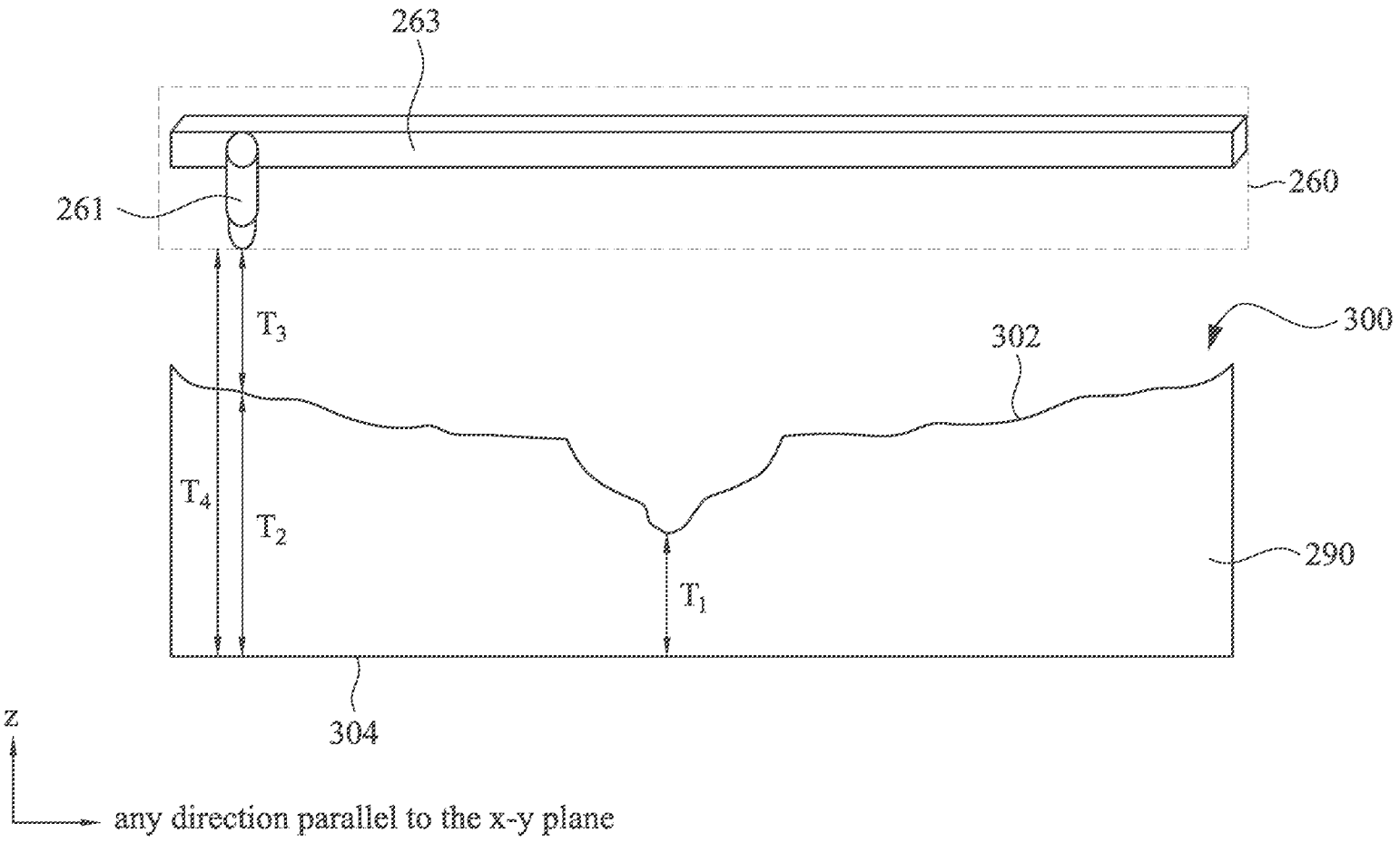
FIG. 3 illustrates a cross-sectional view of a detection module and an area of a polishing pad, according to some embodiments of the present disclosure.

According to some embodiments, FIG. 3 is cross-sectional view of a local area 300 of polishing pad 290 under detection module 260. Local pad area 300 can be a result of the conditioning process performed by conditioner 270 that exerts a downforce to a top surface 302 of polishing pad 290. Local pad area 300 can also be another result of the substrate polishing process performed by substrate carrier 210 that holds substrate 230 and exerts another downforce to top surface 302 of polishing pad 290. Consequently, top surface 302 of local pad area 300 has developed over time a local topography (e.g., a local non-uniformity) which is characterized by features having different thicknesses $T_1$ and $T_2$ across pad area 300 with $T_2$ being thicker than $T_1$ (e.g., $T_2>T_1$). In some embodiments, a thickness difference between a thick (e.g., $T_2$) and a thin (e.g., $T_1$) feature on top surface 302 can be up to 1 mm (e.g., $T_2-T_1\leq 1$ mm). If the aforementioned conditioning process or substrate polishing process continues to treat pad area 300, the topography of pad area 300 will become more pronounced. For example, the thickness difference between the thick and thin feature with thickness $T_1$ and $T_2$ respectively will increase and the uniformity of pad 300 will further deteriorate. As a result of this process, polishing pad 290 will lose its polishing ability.

The profile of pad area 300 can be detected by detection module 260 during the conditioning process and/or the substrate polishing process. For example, probe 261 can measure a distance $T_3$ between probe 261 and the thick feature on top surface 302. By subtracting distance $T_3$ from a previously known distance $T_4$ between probe 261 and a bottom surface 304 of polishing pad 290, detection module 260 can measure thickness $T_2$ ($T_2=T_4-T_3$) of the thick feature on pad area 300. By moving probe 261 along beam 263, a thickness of entire pad area 300 can be measured and collected by detection module 260. In some embodiments, detection module 260 can detect a surface contour of pad area 300 by measuring a distance between each feature and probe 261 (e.g., only measuring $T_3$ without comparing to $T_4$) in some embodiments, detection module 260 can detect a surface roughness of pad area 300, where probe 261 can be configured to measure a surface roughness of pad area 300. In some embodiments, detection module 260 can reconstruct a surface morphology of pad area 300, where probe 261 can be configured to record visual images of pad area 300's surface or detect optical signatures (e.g., optical phase interference or polarization) associated with pad area 300.

Figure 4A:
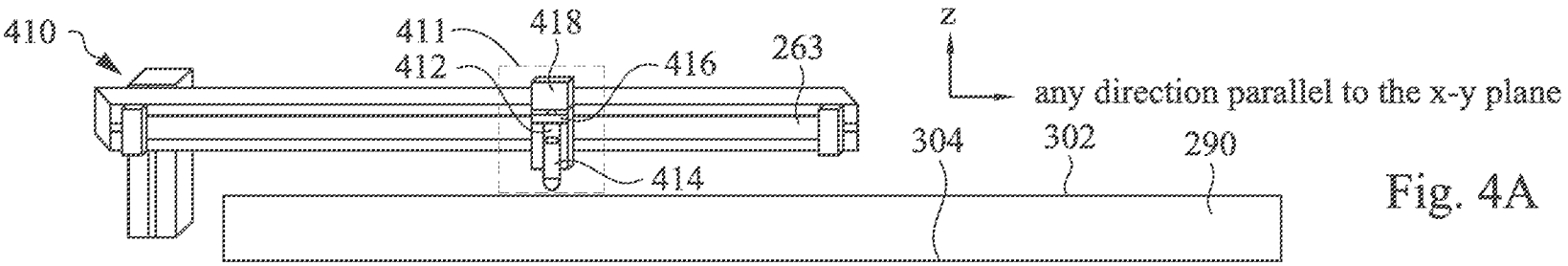
FIGS. 4A-4C illustrate various detection modules, according to some embodiments of the present disclosure.
Figure 4B:
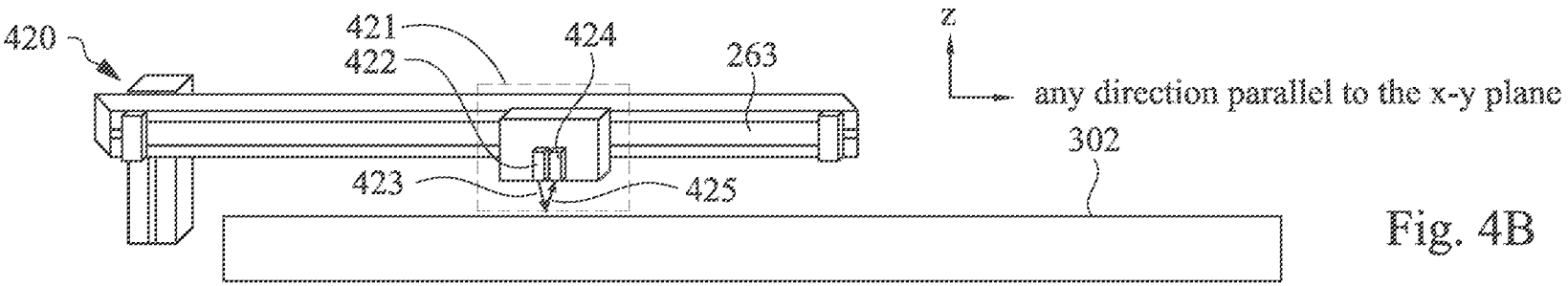
Figure 4C:
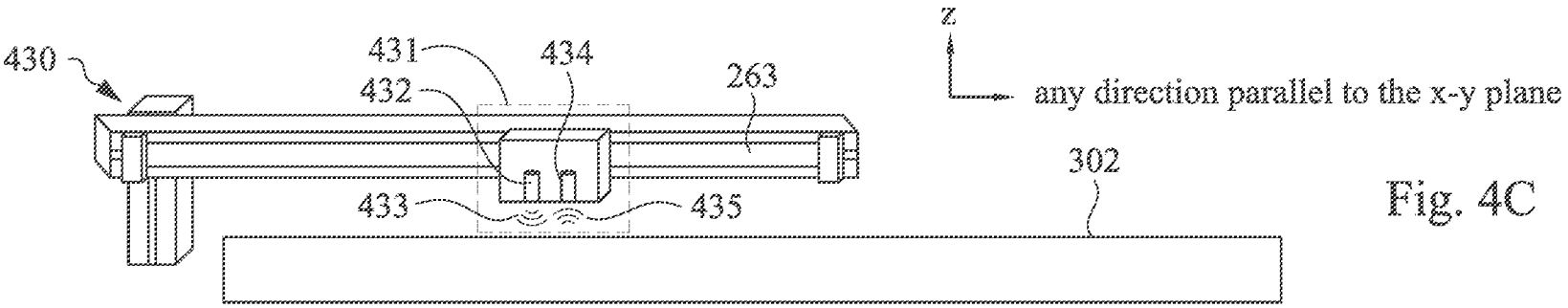

FIGS. 4A-4C illustrate details of various types of detection modules, according to some embodiments of the present disclosure. The discussion of detection module 260 applies to each detection module illustrated in FIGS. 4A-4C unless mentioned otherwise.

FIG. 4A shows a contact-type detection module 410, according to some embodiments of the present disclosure. Detection module 410 can include a contact probe 411 as an embodiment of probe 261, where contact probe 411 can be configured to sense a mechanical signal. In some embodiments, the mechanical signal can include a mechanical pressure signal associated with measuring the profile of one or more areas of polishing pad 290. Contact probe 411 can include a probe rail 412, a pressure probe 414 configured to sense a mechanical pressure between pressure probe 414 and top surface 302 of polishing pad 290, a limit switch 416 configured to determine an upper position limit of pressure probe 414, and a moving mechanism 418 configured to move pressure probe 414 along probe rail 412. In some embodiments, moving mechanism 418 can place pressure probe 414 at the upper limit position before pressure probe 414 starts to measure the profile of polishing pad 290, where a distance between the upper position limit and bottom surface 304 of pad 290 is previously known (e.g., $T_2+T_3$ in FIG. 3 is previously known). In some embodiments, moving mechanism 418 can vertically (e.g., z-directionally) move pressure probe 414 from the upper limit position towards top surface 302 and record a respective vertical moving distance of pressure probe 414. A physical contact between pressure probe 414 and top surface 302 can generate a respective mechanical pressure. In response to the respective mechanical pressure being above a pre-determined pressure threshold, detection module 410 can determine an actual moving distance of pressure probe 414 (e.g., $T_3$ in FIG. 3). For example, pressure probe 414 can be a stylus configured to move vertically along probe rail 412. In response to the stylus's tip contacting top surface 302, a force from top surface 302 pressing against the stylus can be detected by detection module 410. The stylus can be configured to continue to press on top surface 302 until the a specific torque (e.g., the pre-determined pressure threshold) associated with the force is reached. Accordingly, a vertical separation between the upper limit position and the stylus's tip, contacting top surface 302, can determine the actual moving distance of pressure probe 414 (e.g., $T_3$ in FIG. 3). With the above noted distances measured or previously known by pressure probe 414, detection module 410 can scan and reconstruct the profile—including the thickness, the surface contour; and/or the surface roughness—of one or more areas of polishing pad 290. In some embodiments, a force associated with the pre-determined pressure threshold can be between about 0.1 mg and about 30 mg. In some embodiments, a force associated with the pre-determined pressure threshold can be between about 1 mg and about 15 mg. In some embodiments, the radius of pressure probe 414's stylus can be between about 20 nm and about 50 μm. In some embodiments, the radius of pressure probe 414's stylus can be between about 50 nm and about 25 μm.

FIG. 4B shows a non-contact-type detection module 420, according to some embodiments of the present disclosure. Detection module 420 can include an optical module 421 as an embodiment of probe 261, where optical module 421 can be configured to transmit and receive one or more optical signals associated with measuring the profile of the one or more areas on polishing pad 290. Optical module 421 can include an optical transmitter 422 configured to transmit an optical signal 423 towards top surface 302, and an optical receiver 424 configured to receive an optical signal 425 reflected, deflected, or refracted from top surface 302. Due to a distance between optical module 421 and top surface 302 (e.g., $T_3$ in FIG. 3), optical signal 423 can have a respective phase difference or a respective optical path difference from that of optical signal 425. Detection module 420 can be configured to detect the respective phase difference or the optical difference between optical signal 423 and 425 to determine the actual distance between optical module 421 and top surface 302. For example, optical module 421 can be an optical profilometer and can further include a beam splitter (not shown in FIG. 4B). The beam splitter can be configured combine optical signals 423 and 425 to create interference patterns at optical receiver 424. Such interference patterns can include information associated with surface contours/profiles of top surface 302. In some embodiments, optical module 421 can be a digital holography device configured to build holography images of top surface 302 based on the amplitude, phase, and polarization of optical signals 423 and 425. In some embodiments, optical module 421 can be a confocal microscopy device configured to record multiple two-dimensional images of top surface 302 at different focal planes. As a result, similar to detection module 410, detection module 420 can scan and reconstruct the profile—including the images, the thickness, the surface contour, and/or the surface roughness—of one or more areas of polishing pad 290. In some embodiments, a wavelength of optical signals 423 and 425 can be between 300 nm and 750 nm. In some embodiments, a wavelength of optical signals 423 and 425 can be between 450 nm and 700 nm. In some embodiments, optical receiver 424 can include a photo-detector or a charge-coupled device camera.

FIG. 4C shows a non-contact-type detection module 430, according to some embodiments of the present disclosure. Detection module 430 can include an acoustic module 431 as an embodiment of probe 261, where acoustic module 431 can be configured to transmit and receive one or more acoustic signals associated with measuring the profile of the one or more areas on polishing pad 290. Acoustic module 431 can include an acoustic transmitter 432 configured to receive an acoustic signal 435 reflected, deflected, or refracted from top surface 302. Detection module 430 can be configured to detect a phase difference between acoustic signals 433 and 435 to determine the actual distance between acoustic module 431 and top surface 302, and therefore can detect the profile of one or more areas of polishing pad 290. In some embodiments, acoustic module 431 can be an ultrasound-based device or a sonar-based device.

Figure 5:
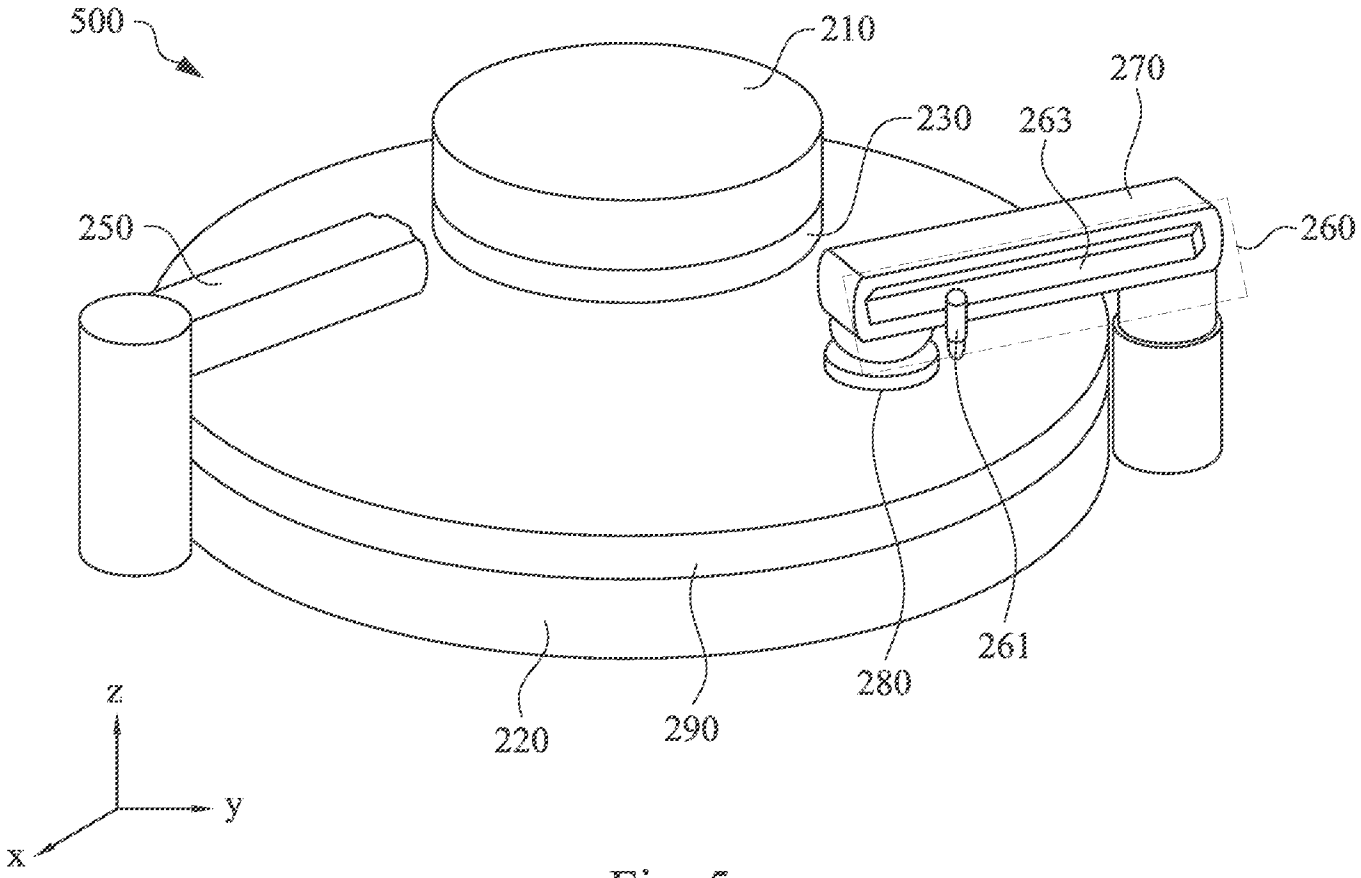
FIG. 5 illustrates a schematic of a polishing apparatus, according to some embodiments of the present disclosure.

FIG. 5 is a schematic of a polishing apparatus 500, according to some embodiments of the present disclosure. The discussion of polishing apparatus 200 applies to polishing apparatus 500 unless mentioned otherwise. As illustrated in FIG. 5, polishing apparatus 500 can include a detection module 260 attached to conditioner 270. As a result, probe 261 can be extended over and swept across the surface of polishing pad 290. In some embodiments, probe 261 is a non-contact type probe (e.g., optical type or acoustic type) and can detect the profile of one or more areas of polishing pad 290 substantially closed to conditioning disk 280.

Figure 6:
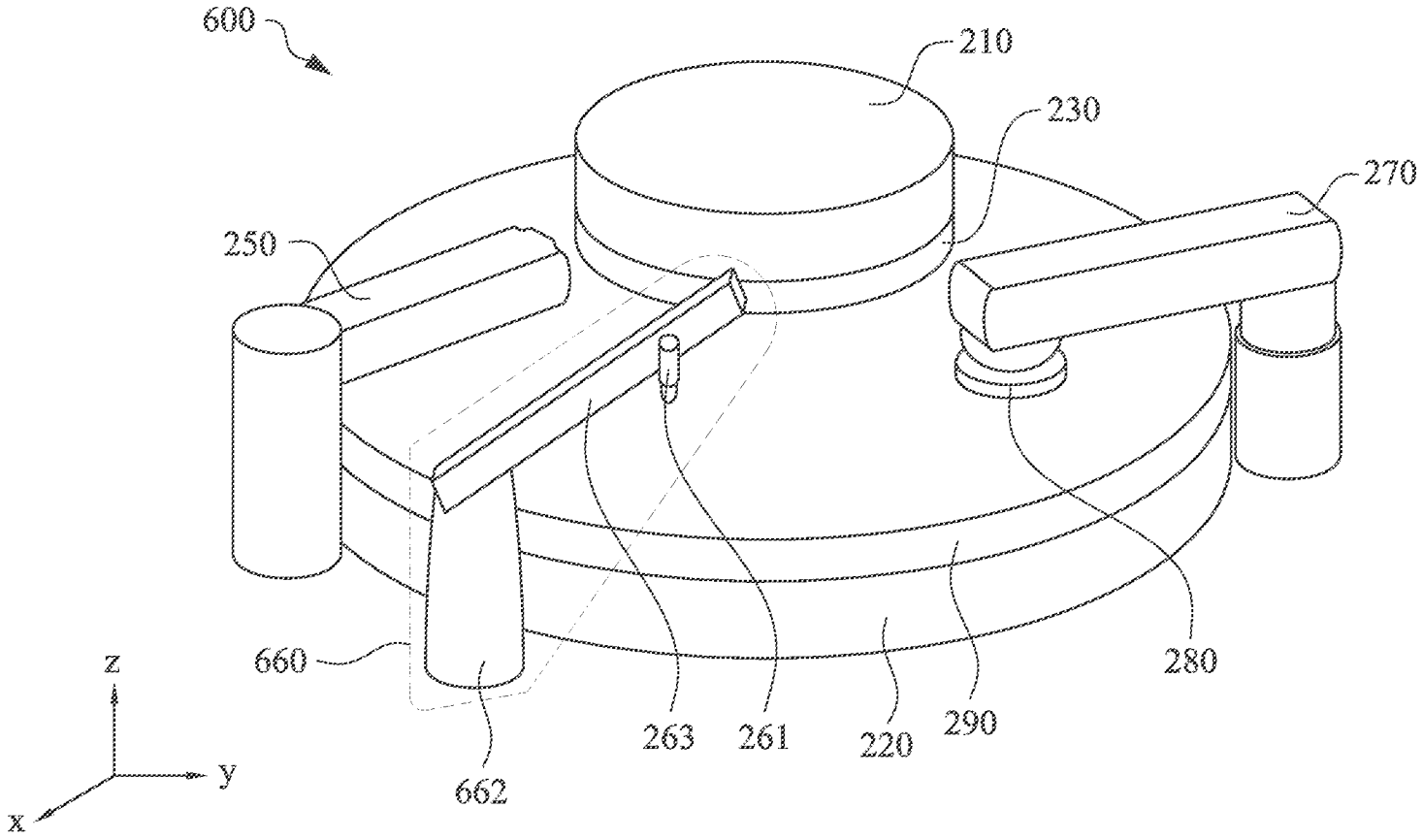
FIG. 6 illustrates a schematic of a polishing apparatus, according to some embodiments of the present disclosure.

FIG. 6 is a schematic of a polishing apparatus 600, according to some embodiments of the present disclosure. The discussion of polishing apparatus 200 applies to polishing apparatus 600, unless mentioned otherwise. As illustrated in FIG. 6, polishing apparatus 600 can include a stand-alone detection module 660, where the discussion of detection module 260 applies to stand-alone detection module 660, unless mentioned otherwise. Stand-alone detection module 660 can include probe 261, beam 263, and a base 662 configured to support beam 263. Base 662 can be positioned adjacent to polishing pad 290, and thus enables beam 263 to be extended over polishing pad 290. In some embodiments, base 662 can be further configured to rotate beam 263, and therefore enables beam 263 to be swept across a surface of polishing pad 290. In some embodiments, base 662 can be adjacent to slurry dispenser 250 or conditioner 270.

Figure 7:
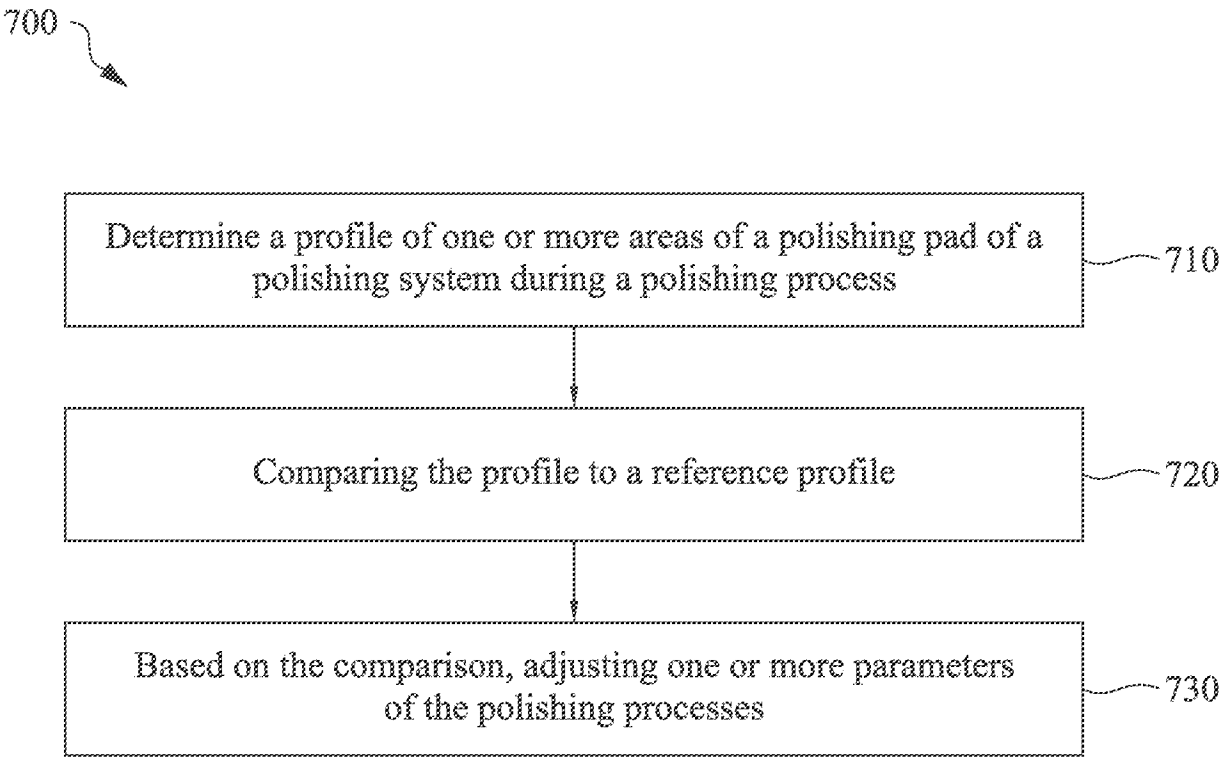
FIG. 7 illustrates a method for operating a polishing system, according to some embodiments of the present disclosure.

FIG. 7 is a method 700 for operating a polishing system, according to some embodiments of the present disclosure. Operations shown in method 700 are not exhaustive; other operations can be performed as well before, after, or between any of the illustrated operations. In some embodiments, operations of method 700 can be performed in a different order. Variations of method 700 are within the scope of the present disclosure.

Method 700 begins with operation 710, where a profile of one or more areas of a polishing pad of a polishing system is determined during a polishing process, including a substrate polishing process or a conditioning process. The profile of the polishing pad can be determined by a detection module of the polishing system. During determination of the profile, the polishing pad can be rotating or still. The detection module can determine the profile based on measuring a respective thickness of the one or more areas of the polishing pad. In some embodiments, the detection module can determine the profile based on measuring a respective surface contour or surface roughness of the one or more area of the polishing pad. In some embodiments, the detection module can determine the profile based on recorded images of the one or more areas of the polishing pad. In some embodiments, the determination the profile of the pad can be referred to the descriptions of FIGS. 2-6.

In operation 720, the profile of one or more areas of the polishing pad is compared to a reference profile. The reference profile can be a pre-determined profile of a reference polishing pad. For example, the pre-determined profile can be a pad profile of the polishing pad which exhibits a uniform thickness across the entire reference polishing pad. In some embodiments, the pre-determined profile can also be a pad profile of the reference polishing pad which thickness distribution can be described by a mathematical equation (e.g., a monotonic function with respect to the polishing pad's radius.) In some embodiments, the pre-determined profile can be a pad profile of a new polishing pad that was not used for any polishing process. In some embodiments, the pre-determined profile can be one or more images of a surface of the reference polishing pad, where the reference polishing pad can be a new polishing pad or a polishing pad with a uniform thickness. The comparison of the profile and the reference profile can include subtracting the profile from the reference profile. In some embodiments, the comparison can include subtracting the profile from an averaged attribute (e.g., thickness or surface roughness) of the reference profile. In some embodiments, the comparison can include pixel-to-pixel subtraction of the profile from the one or more images of the reference polishing pad. In some embodiments, the comparison can be performed by the computer system as described in FIG. 1.

In some embodiments, the reference profile can be a simulated profile of the polishing pad. The simulated profile can be generated by a mathematical process for predicting a projected wear of the polishing pad caused by the polishing process. For example, the polishing process can be a conditioning process, where the mathematical process can predict the polishing pad wear by taking into account a simulated moving trajectory of a conditioning disk of the polishing system and a respective simulated polishing strength of the conditioning process along the moving trajectory. In some embodiments, the simulated polishing strength of the conditioning process can be determined by a radius of the polishing pad, a rotation speed of the polishing pad, and a rotation speed of the conditioning disk.

In some embodiments, the simulated profile can be generated by a machine learning process, where training data for the machine learning process can include historical characteristics of another polishing pad used in a previous polishing process. For example, the other polishing pad can exhibit a resulting profile after being used for a previous conditioning process. The resulting profile and one or more parameters of the previous conditioning process can be included in the training data. The training data can follow a training procedure to train the machine learning process. The trained machine learning process (e.g., configured with optimized parameters) can generate the simulated profile based on the one or more parameters of current on-going polishing processes. In some embodiments, the machine learning process can include a supervised machine learning process, such as linear regression, decision tree, random forest, support vector machine, artificial neural network, convolution neural network, recurrent neural network, or deep learning, where the supervised machine learning process can be trained or optimized by introducing the training data through one or more training procedures (e.g., gradient decent algorithm) associated with the supervised machine learning process.

In some embodiments, the simulated profile can be generated by a big data mining process which takes account historical characteristics of other polishing pads used in previous polishing processes. For example, the simulated profile can be an average profile of the other polishing pads. In some embodiments, the simulated profile can be a profile by averaging profiles of a first group of the other polishing pads and excluding a second group of the other polishing pads as outliers.

In operation 730, one or more parameters of the polishing process are adjusted based on the comparison between the profile and the reference profile, where the adjustment can be performed by the computer system as described in FIG. 1. The comparison can indicate an existing wear of the one or more areas of the polishing pad, while the adjustment can minimize further wear on the one or more areas of the polishing pad caused by an on-going or a past polishing process. For example, during a conditioning process, the comparison between the profile and the reference profile can indicate a first region (e.g., a central region) of the polishing pad is substantially thinner than that at other regions (e.g., an edge region) of the polishing pad. As a result, the conditioning disk can be adjusted to move away from the first region of the polishing pad while the conditioning process can be on-going. Similarly, during a polishing process, the computer system can adjust a location of a substrate carrier to move away from a heavily-worn region of the polishing pad. In some embodiments, based on the comparison between the profile and the reference profile, a rotation speed of the polishing pad, a location of a substrate carrier of the polishing system, a rotation speed of the substrate carrier, a pressure applied by the substrate carrier, a flow rate of a slurry supply of the polishing system, a location of the slurry supply, a rotation speed of the conditioner, and/or a pressure applied by the conditioner can be adjusted to minimize further wear on the polishing pad.

Figure 8:
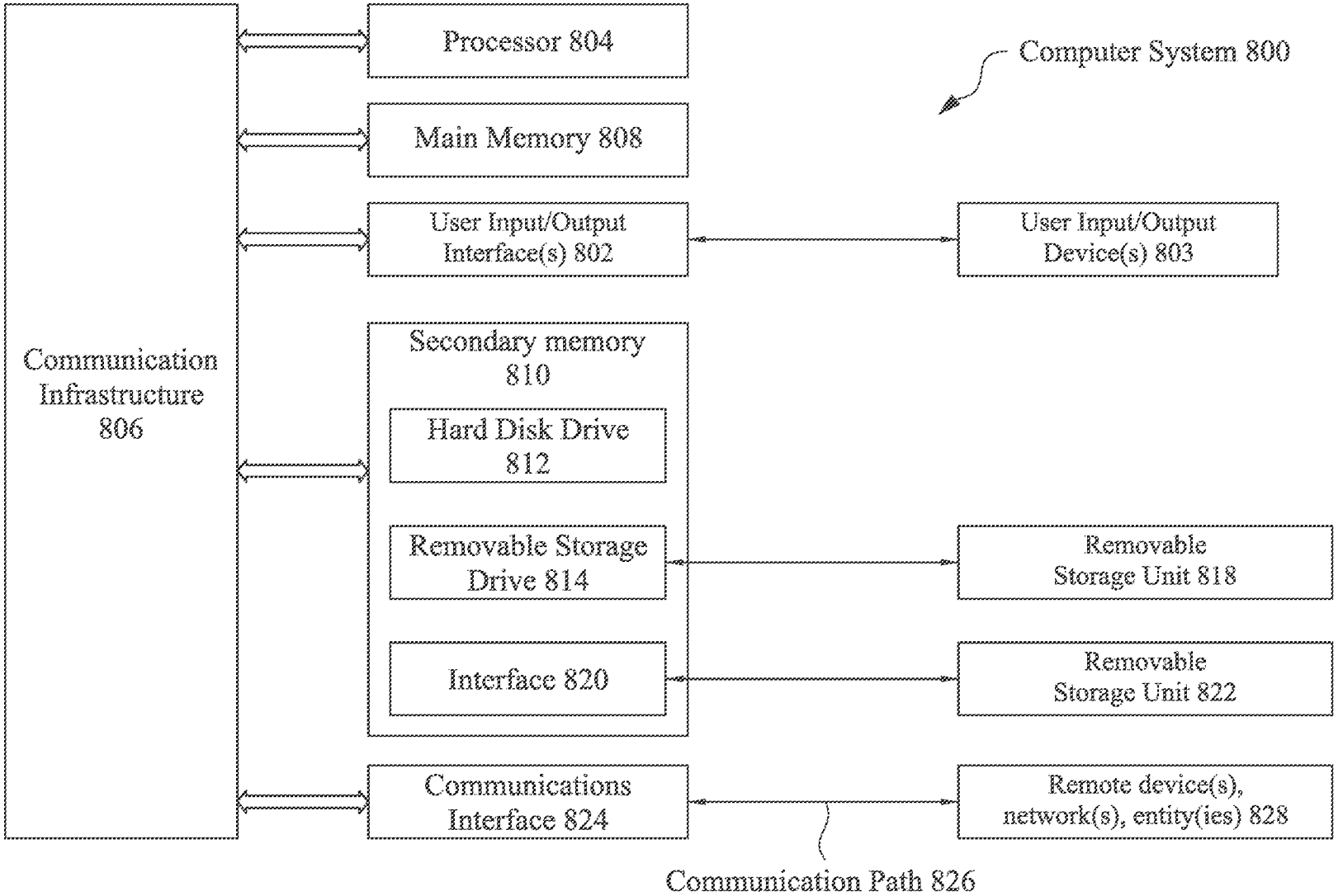
FIG. 8 illustrates a high-level block diagram of an example computer system, according to some embodiments of the present disclosure.

Various aspects of the embodiments may be implemented in software, firmware, hardware, or a combination thereof. FIG. 8 is an illustration of an example computer system 800 in which embodiments of the present disclosure, or portions thereof, can be implemented as computer-readable code. Various embodiments of the present disclosure are described in terms of this example computer system 800, such as computer system 130 of FIG. 1.

Computer system 800 can be an example of computer system 130, and can include one or more processors, such as processor 804. Processor 804 is connected to a communication infrastructure 806 (e.g., a bus or network).

Computer system 800 also includes a main memory 808, such as random access memory (RAM), and may also include a secondary memory 810. Secondary memory 810 can include, for example, a hard disk drive 812, a removable storage drive 814, and/or a memory stick. Removable storage drive 814 can include a floppy disk drive, a magnetic tape drive, an optical disk drive, a flash memory, or the like. Removable storage drive 814 reads from and/or writes to a removable storage unit 818 in a well-known manner. Removable storage unit 818 can include a floppy disk, magnetic tape, optical disk, flash drive, etc., which is read by and written to by removable storage drive 814. Removable storage unit 818 includes a computer-readable storage medium having stored therein computer software and/or data. Computer system 800 includes user input/output interface(s) 802 (which can include user input/output devices 803, such as keyboards, mice, etc.) that forwards graphics, text, and other data from communication infrastructure 806 (or from a frame buffer not shown).

In alternative implementations, secondary memory 810 can include other similar devices for allowing computer programs or other instructions to be loaded into computer system 800 (e.g., loaded into main memory 808). Such devices can include, for example, a removable storage unit 822 and an interface 820. Examples of such devices include a program cartridge and cartridge interface (such as those found in video game devices), a removable memory chip (e.g., EPROM or PROM) and associated socket, and other removable storage units 822 and interfaces 820 which allow software and data to be transferred from the removable storage unit 822 to computer system 800.

Computer system 800 can also include a communications interface 824. Communications interface 824 allows software and data to be transferred between computer system 800 and external devices. Communications interface 824 can include a modem, a network interface (such as an Ethernet card), a communications port, or the like. Software and data transferred via communications interface 824 are in the form of signals which may be electronic, electromagnetic, optical, or other signals capable of being received by communications interface 824. These signals are provided to communications interface 824 via a communications path 826. Communications path 826 carries signals and can be implemented using wire or cable, fiber optics, a phone line, a cellular phone link, a RF link, or other communications channels.

In this document, the terms "computer program storage medium" and "computer-readable storage medium" are used to generally refer to non-transitory media such as removable storage unit 818, removable storage unit 822, and a hard disk installed in hard disk drive 812. Computer program storage medium and computer-readable storage medium can also refer to memories, such as main memory 808 and secondary memory 810, which can be semiconductor memories (e.g., DRAMs, etc.). Embodiments of the present disclosure can employ any computer-readable medium, known now or in the future. Examples of computer-readable storage media include, but are not limited to, non-transitory primary storage devices (e.g., any type of random access memory), and non-transitory secondary storage devices (e.g., hard drives, floppy disks, CD ROMS, ZIP disks, tapes, magnetic storage devices, optical storage devices, MEMS, nanotechnological storage devices, etc.).

These computer program products provide software to computer system 800. Embodiments of the present disclosure are also directed to computer program products including software stored on any computer-readable storage medium. Such software, when executed in one or more data processing devices, causes a data processing device(s) to operate as described herein.

Computer programs (also referred to herein as "computer control logic") are stored in main memory 808 and/or secondary memory 810. Computer programs may also be received via communications interface 824. Such computer programs, when executed, enable computer system 800 to implement various embodiments of the present disclosure. In particular, the computer programs, when executed, enable processor 804 to implement processes of embodiments of the present disclosure, such as the operations in method 700 illustrated by FIG. 7. Where embodiments of the present disclosure are implemented using software, the software can be stored in a computer program product and loaded into computer system 800 using removable storage drive 814, interface 820, hard drive 812, or communications interface 824.

The functions/operations in the preceding embodiments can be implemented in a wide variety of configurations and architectures. Therefore, some or all of the operations in the preceding embodiments—e.g., functions of polishing system 100 described in FIG. 1, functions of polishing apparatus 200, and method 700 described in FIG. 7—can be performed in computer system 800 (e.g., by processor 804), in hardware, in software or in combination thereof. In some embodiments, a tangible apparatus or article of manufacture including a tangible computer useable or readable medium having control logic (software) stored thereon is also referred to herein as a computer program product or program storage device. This includes, but is not limited to, computer system 800, main memory 808, secondary memory 810 and removable storage units 818 and 822, as well as tangible articles of manufacture embodying any combination of the foregoing. Such control logic, when executed by one or more data processing devices (such as computer system 800), causes such data processing devices to operate as described herein. For example, the hardware/equipment can be connected to or be part of element 828 (remote device(s), network(s), entity(ies) 828) of computer system 800.

The present disclosure provides a polishing apparatus and a method for a polishing process that uses a detection module to detect a profile of one or more areas of a polishing pad during the polishing process. The detection module can include a probe configured to measure a profile of the polishing pad and a beam configured to support the probe. One or more parameters of the polishing process can be adjusted based on a comparison between the detected profile and a reference profile. Such polishing apparatus can provide in-situ detection of wear on the polishing pad during the polishing process, reduce the time to evaluate a condition of the polishing pad, and prolong a life span of the polishing pad.

In some embodiments, an apparatus for polishing a substrate can include a polishing pad configured to polish the substrate, a substrate carrier configured to hold the substrate against the polishing pad, and a detection module configured to detect a profile of the polishing pad. The detection module can include a probe configured to measure a thickness of one or more areas on the polishing pad, and a beam configured to support the probe, where the probe can be further configured to move along the beam.

In some embodiments, a method for operating a polishing system can include determining a profile of one or more areas of a polishing pad of a polishing system during a polishing process, comparing the profile to a reference profile, and adjusting one or more parameters of the polishing process based on the comparison.

In some embodiments, a polishing system for a polishing process can include a polishing apparatus and a computer system configured to communicate with the polishing apparatus. The polishing apparatus can include a polishing pad and a detection module configured to detect a profile of one or more areas of the polishing pad during the polishing process. The computer system can include a memory configured to store instructions for adjusting one or more parameters of the polishing process and a processor configured to receive the profile from the polishing apparatus, compare the profile to a reference profile, and update the instructions based on the comparison of the profile to the reference profile.

It is to be appreciated that the Detailed Description section, and not the Abstract of the Disclosure, is intended to be used to interpret the claims. The Abstract of the Disclosure section can set forth one or more but not all embodiments contemplated and thus, are not intended to be limiting to the subjoined claims.

The foregoing disclosure outlines features of several embodiments so that those skilled in the art can better understand the aspects of the present disclosure. Those skilled in the art will appreciate that they can readily use the present disclosure as a basis for designing or modifying other processes and structures for carrying out the same purposes and/or achieving the same advantages of the embodiments introduced herein. Those skilled in the art will also realize that such equivalent constructions do not depart from the spirit and scope of the present disclosure, and that they can make various changes, substitutions, and alterations herein without departing from the spirit and scope of the subjoined claims

What is claimed is:

1. An apparatus for polishing a substrate, comprising:

a polishing pad configured to polish the substrate;

a substrate carrier configured to hold the substrate against the polishing pad;

a conditioner configured to condition the polishing pad;

a detection module configured to detect a profile of the polishing pad, wherein the detection module comprises:

a probe configured to measure a thickness of one or more areas on the polishing pad; and a beam configured to support e probe, wherein the probe is further configured to move along the beam; and a control device configured to:

simulate a moving trajectory of the conditioner to generate a reference profile; and compare the profile to the reference profile of the polishing pad stored in the control device.

2. The apparatus of claim 1, further comprising a slurry dispenser configured to dispense a CMP slurry onto a surface of the polishing pad, wherein the detection module is attached to the slurry dispenser.

3. The apparatus of claim 1, wherein the detection module is attached to the conditioner.

4. The apparatus of claim 1, wherein the detection module further comprises a base configured to support the beam, and wherein the base is positioned adjacent to the polishing pad.

5. The apparatus of claim 1, wherein the beam is further configured to extend over the polishing pad, and sweep across a surface of the polishing pad.

6. The apparatus of claim 1, wherein the detection module is further configured to detect the profile of the polishing pad during a polishing process.

7. The apparatus of claim 1, wherein the probe comprises an optical module configured to transmit and receive one or more optical signals associated with thickness measurements of the one or more areas on the polishing pad.

8. The apparatus of claim 1, wherein the probe comprises an acoustic module configured to transmit and receive one or more acoustic signals associated with thickness measurements of the one or more areas on the polishing pad.

9. The apparatus of claim 1, wherein the probe comprises a contact probe configured to sense a mechanical pressure signal associated with thickness measurements of the one or more areas on the polishing pad.

10. An apparatus, comprising:

a polishing pad;

a detection module above a surface of the polishing pad and comprising a probe configured to:

extend over and sweep across the surface; and measure a surface contour of the surface; and a control device configured to store a predetermined reference profile of the polishing pad and compare the surface contour to the predetermined reference profile, wherein the predetermined reference profile is based on a simulation of a moving trajectory of a conditioning disk performing a conditioning process on the polishing pad.

11. The apparatus of claim 10, wherein the probe is further configured to measure a distance between the probe and the surface.

12. The apparatus of claim 10, wherein the probe is further configured to sense a pressure between the probe and the surface.

13. The apparatus of claim 10, wherein the probe is further configured to:

transmit a first optical signal to the surface;

receive a second optical signal from the surface; and generate a holography image of the surface based on the first and second optical signals.

14. The apparatus of claim 10, further comprising a slurry dispenser configured to disperse a slurry on the surface, wherein the probe is attached to the slurry dispenser.

15. An apparatus, comprising:

a polishing pad;

a detection module above a surface of the polishing pad and comprising a probe configured to measure a surface contour of the surface;

a control device configured to:

perform a simulation of a polishing process to predict a projected wear of the polishing pad;

generate and store a reference profile of the surface of the polishing pad based on the simulation; and compare the surface contour to the reference profile; and a conditioner above the surface and configured to condition the surface based on a comparison between the surface contour and the reference profile.

16. The apparatus of claim 15, wherein a pressure applied by the conditioner is adjustable based on the comparison between the surface contour and the reference profile.

17. The apparatus of claim 15, wherein the detection module is attached to the conditioner.

18. The apparatus of claim 15, wherein the control device is further configured to adjust a rotation speed of the polishing pad based on the comparison between the surface contour and the reference profile.

19. The apparatus of claim 15, further comprising a substrate carrier configured to hold a substrate against the polishing pad, wherein the control device is further configured to adjust a rotation speed of the substrate carrier, a location of the substrate carrier, or a pressure applied by the substrate carrier based on the comparison between the surface contour and the reference profile.

20. The apparatus of claim 15, further comprising a slurry dispenser configured to move above the surface and dispense a slurry onto the surface, wherein the control device is further configured to adjust a location of the slurry dispenser or a flow rate of the slurry based on the comparison between the surface contour and the reference profile.

* * * * *